US008632297B2

(12) United States Patent
Maldonado et al.

(10) Patent No.: US 8,632,297 B2
(45) Date of Patent: Jan. 21, 2014

(54) TURBINE AIRFOIL AND METHOD FOR COOLING A TURBINE AIRFOIL

(75) Inventors: Jaime Javier Maldonado, Simpsonville, SC (US); Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 663 days.

(21) Appl. No.: 12/893,506

(22) Filed: Sep. 29, 2010

(65) Prior Publication Data

US 2012/0076654 A1 Mar. 29, 2012

(51) Int. Cl.
*F01D 5/18* (2006.01)

(52) U.S. Cl.
USPC ..... 415/115

(58) Field of Classification Search
USPC ..... 415/115, 116, 191; 416/96 R, 97 R, 416/193 A
See application file for complete search history.

(56) References Cited

U.S. PATENT DOCUMENTS

| | | | | |
|---|---|---|---|---|
| 4,767,261 | A * | 8/1988 | Godfrey et al. | 415/115 |
| 5,344,283 | A | 9/1994 | Magowan et al. | |
| 6,036,436 | A | 3/2000 | Fukuno et al. | |
| 6,190,120 | B1 | 2/2001 | Thatcher et al. | |
| 6,206,638 | B1 | 3/2001 | Glynn et al. | |
| 6,325,593 | B1 | 12/2001 | Darkins, Jr. et al. | |
| 6,329,015 | B1 * | 12/2001 | Fehrenbach et al. | 427/142 |
| 6,418,618 | B1 * | 7/2002 | Burdgick | 29/889 |
| 6,616,406 | B2 | 9/2003 | Liang | |
| 7,165,940 | B2 | 1/2007 | McGrath et al. | |
| 7,785,072 | B1 * | 8/2010 | Liang | 416/97 R |
| 2003/0037436 | A1 * | 2/2003 | Ducotey et al. | 29/889.1 |
| 2003/0044276 | A1 | 3/2003 | Leeke et al. | |
| 2003/0108423 | A1 | 6/2003 | Morgan et al. | |
| 2003/0129054 | A1 * | 7/2003 | Manning et al. | 415/115 |
| 2004/0094524 | A1 * | 5/2004 | Stevens | 219/121.71 |
| 2005/0249593 | A1 * | 11/2005 | Boury et al. | 416/97 R |
| 2006/0222497 | A1 * | 10/2006 | Lee | 416/97 R |

* cited by examiner

*Primary Examiner* — Edward Look
*Assistant Examiner* — Liam McDowell
(74) *Attorney, Agent, or Firm* — Cantor Colburn LLP

(57) ABSTRACT

According to one aspect of the invention, a turbine includes a first sidewall, an airfoil positioned between the first sidewall and a second sidewall and a first passage in the airfoil proximate a high temperature region, the first passage configured to receive a cooling fluid, wherein the high temperature region is near an interface of the first sidewall and a trailing edge of the airfoil. The turbine further includes a first diffuser in fluid communication with the first passage, the first diffuser configured to direct the cooling fluid to form a film on a surface of the first sidewall.

20 Claims, 5 Drawing Sheets

TURBINE AIRFOIL AND METHOD FOR COOLING A TURBINE AIRFOIL

BACKGROUND OF THE INVENTION

The subject matter disclosed herein relates to turbines. More particularly, the subject matter relates to an airfoil to be positioned in a turbine.

In a gas turbine engine, a combustor converts chemical energy of a fuel or an air-fuel mixture into thermal energy. The thermal energy is conveyed by a fluid, often air from a compressor, to a turbine where the thermal energy is converted to mechanical energy. Several factors influence the efficiency of the conversion of thermal energy to mechanical energy. The factors may include blade passing frequencies, fuel supply fluctuations, fuel type and reactivity, combustor head-on volume, fuel nozzle design, air-fuel profiles, flame shape, air-fuel mixing, flame holding, combustion temperature, turbine component design, hot-gas-path temperature dilution, and exhaust temperature. For example, high combustion temperatures in selected locations, such as the combustor and turbine nozzle areas, may enable improved combustion efficiency and power production. In some cases, high temperatures in certain combustor and turbine regions may shorten the life and increase wear and tear of certain components. Accordingly, it is desirable to manage temperatures in the turbine to reduce wear and increase the life of turbine components.

BRIEF DESCRIPTION OF THE INVENTION

According to one aspect of the invention, a turbine includes a first sidewall, an airfoil positioned between the first sidewall and a second sidewall and a first passage in the airfoil proximate a high temperature region, the first passage configured to receive a cooling fluid, wherein the high temperature region is near an interface of the first sidewall and a trailing edge of the airfoil. The turbine further includes a first diffuser in fluid communication with the first passage, the first diffuser configured to direct the cooling fluid to form a film on a surface of the first sidewall.

According to another aspect of the invention, a method for cooling an interface of a trailing edge of an airfoil and a sidewall of a gas turbine is disclosed. The method includes directing a cooling fluid to at least one passage in the trailing edge, directing the cooling fluid from the at least one passage to a diffuser proximate the interface of the trailing edge and the sidewall and flowing the cooling fluid from the diffuser to form a film on a surface of the sidewall, thereby cooling the sidewall.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
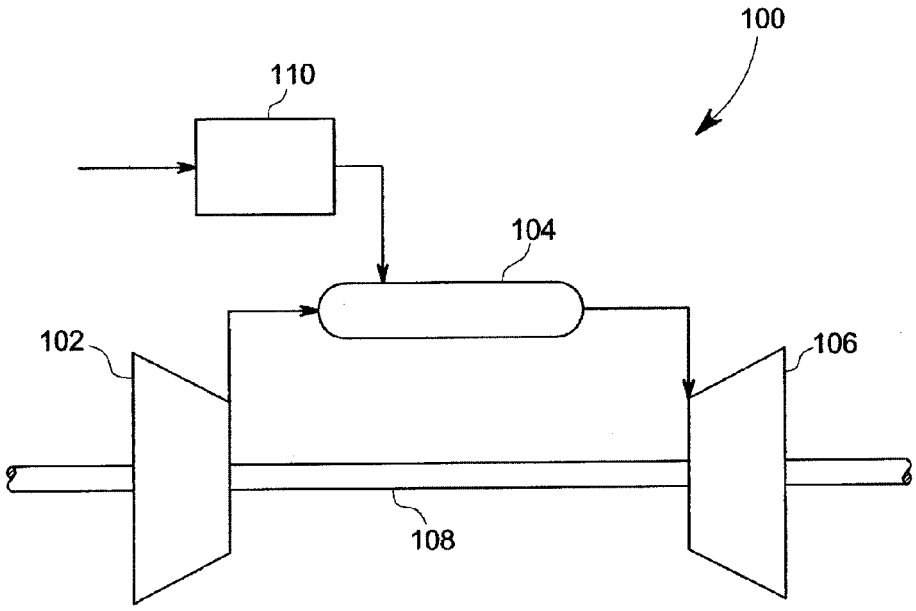
FIG. 1 is a schematic drawing of an embodiment of a gas turbine engine, including a combustor, fuel nozzle, compressor and turbine.

FIG. 1 is a schematic diagram of an embodiment of a gas turbine system 100. The system 100 includes a compressor 102, a combustor 104, a turbine 106, a shaft 108 and a fuel nozzle 110. In an embodiment, the system 100 may include a plurality of compressors 102, combustors 104, turbines 106, shafts 108 and fuel nozzles 110. As depicted, the compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the turbine engine. For example, fuel nozzles 110 are in fluid communication with a fuel supply and pressurized air from the compressor 102. The fuel nozzles 110 create an air-fuel mix, and discharge the air-fuel mix into the combustor 104, thereby causing a combustion that creates a hot pressurized exhaust gas. The combustor 104 directs the hot pressurized exhaust gas through a transition piece into a turbine nozzle (or "stage one nozzle"), causing turbine 106 rotation as the gas exits the nozzle or vane and gets directed to the turbine bucket or blade. The rotation of turbine 106 causes the shaft 108 to rotate, thereby compressing the air as it flows into the compressor 102. In an embodiment, airfoils (also nozzles or buckets) are located in various portions of the turbine, such as in the compressor 102 or the turbine 106, where gas flow across the airfoils causes wear and thermal fatigue of turbine parts, due to non-uniform temperatures. Controlling the temperature of parts of the turbine airfoil and nearby sidewalls can reduce wear and enable higher combustion temperature in the combustor, thereby improving performance. Cooling of regions proximate airfoils and sidewalls of turbines is discussed in detail below with reference to FIGS. 2-5. Although the following discussion primarily focuses on gas turbines, the concepts discussed are not limited to gas turbines.

Figure 2:
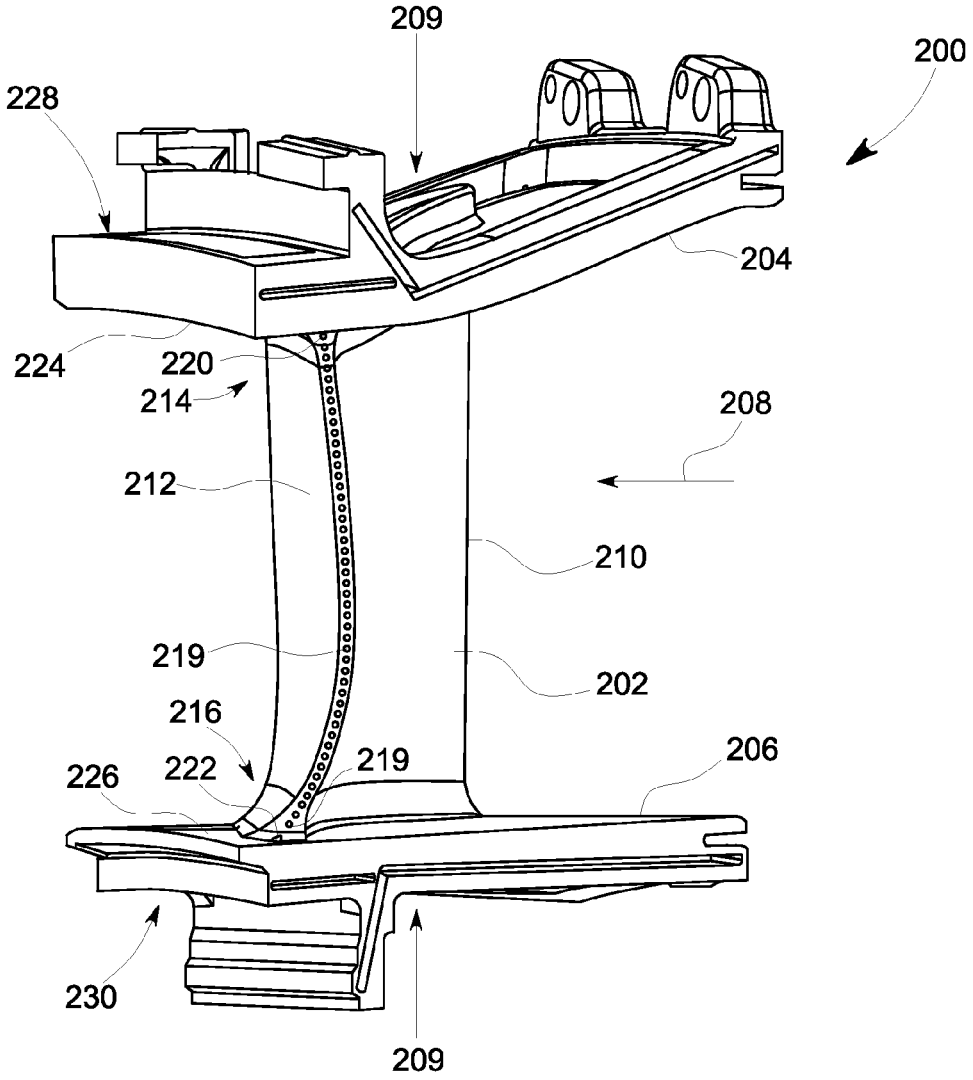
FIG. 2 is a perspective view of an embodiment of a turbine nozzle section.

FIG. 2 is a perspective view of an embodiment of a turbine nozzle section 200. The nozzle 200 includes an airfoil 202 positioned between an outer sidewall 204 and inner sidewall 206. The turbine nozzle 200 receives a hot gas flow 208 from a combustor, wherein the flow causes a rotation of turbine buckets (also referred to as "bucket airfoils"). In an aspect, the hot gas flow 208 is pressurized as it flows past the leading edge 210 and trailing edge 212 of the airfoil 202. The trailing edge 212 is coupled to the outer sidewall 204 and inner sidewall 206 at interfaces 214 and 216, respectively. As the hot gas 208 flows across the airfoil 202, cooling passages 219 direct cooling fluid 209 into the hot gas, thereby cooling selected regions of the nozzle 200 such as the trailing edge 212. In one embodiment, rows of cooling passages 219 are located in the airfoil 202, wherein the cooling fluid 209 is used to cool the airfoil 202 and sidewalls 204 and 206.

As depicted, the airfoil 202 includes passages 219 located along the trailing edge 212. A diffuser 220 is coupled to at least one passage 219 proximate the interface 214 of trailing edge 212 and outer sidewall 204. Similarly, a diffuser 222 is coupled to at least one passage 219 proximate the interface 216 of trailing edge 212 and inner sidewall 206. The diffusers 220 and 222 may be any suitable configuration and shape to cause the flow of cooling fluid to cool a region near interfaces 214 and 216. In one embodiment, at least one of diffusers 220 and 222 is elliptical shaped, as discussed below with respect to FIG. 4. In another embodiment, at least one of diffusers 220 and 222 is triangular shaped, as discussed below with respect to FIG. 5. In addition, the geometry of diffusers 220 and 222 may be described as a contoured opening that promotes formation of a film of cooling fluid on the sidewall (204, 206). As shown in FIG. 2, the diffusers 220 and 222 are configured to control a temperature of surfaces 224 and 226 of sidewalls 204 and 206, respectively. In addition, the nozzle 200 may also use a flow of cooling fluid along sidewall backsides 228 and 230 to control a temperature of the sidewalls 204 and 206, respectively.

Still referring to the embodiment of FIG. 2, cooling fluid flows from passages 219 in airfoil 202, wherein the passages 219 proximate interfaces 214 and 216 direct the cooling fluid through diffusers 220 and 222, respectively. The cooling fluid cools turbine regions or zones of hot gas path as well as nozzle 200 components, such as airfoil 202 and sidewalls 204 and 206. For example, the diffusers 220 and 222 are configured to form a film of cooling fluid on sidewall surfaces 224 and 226, wherein the film cools the sidewalls 204 and 206, respectively. In addition, passages 219 of diffusers 220 and 222 provide convection and conduction cooling to the trailing edge 212. Further, the film of cooling fluid insulates the sidewalls 204 and 206 from high temperatures that form in zones near interfaces 214 and 216 due to high pressure as the hot gas flows past airfoil 202. In embodiments, the cooling fluid is any suitable fluid that cools the nozzle components and selected regions of gas flow, such as high temperature and pressure regions within the nozzle. For example, the cooling fluid is a supply of compressed air from the compressor, wherein the compressed air is diverted from the air supply routed to the combustor. Thus, the cooling fluid is a supply of compressed air, which bypasses the combustor and is used to cool the turbine nozzle components. Accordingly, the diffusers 220 and 222 located near interfaces 214 and 216, respectively, reduce the amount of compressed air used for cooling by improving cooling of the turbine components and regions near the components. As a result, an increased amount of compressed air is directed to the combustor for conversion to mechanical output to improve overall performance and efficiency of the turbine engine while extending turbine nozzle part life by reducing oxidation and thermal fatigue. Further, the disclosed arrangement of the turbine nozzle 200 and cooling components (219, 220, 222) enable lower temperatures as well as a more uniform temperature distribution among the sidewall 204, 206 and trailing edge 212. In aspects, turbine parts, including the airfoils and sidewalls, are formed of stainless steel or an alloy, where the parts may experience thermal fatigue if not properly cooled during engine operation. It should be noted that the apparatus and method for controlling temperature in a turbine engine may apply to cooling of turbine nozzles, as shown in FIGS. 2-5, as well as buckets, compressor vanes or any other airfoil or blades within a turbine engine.

Figure 3:
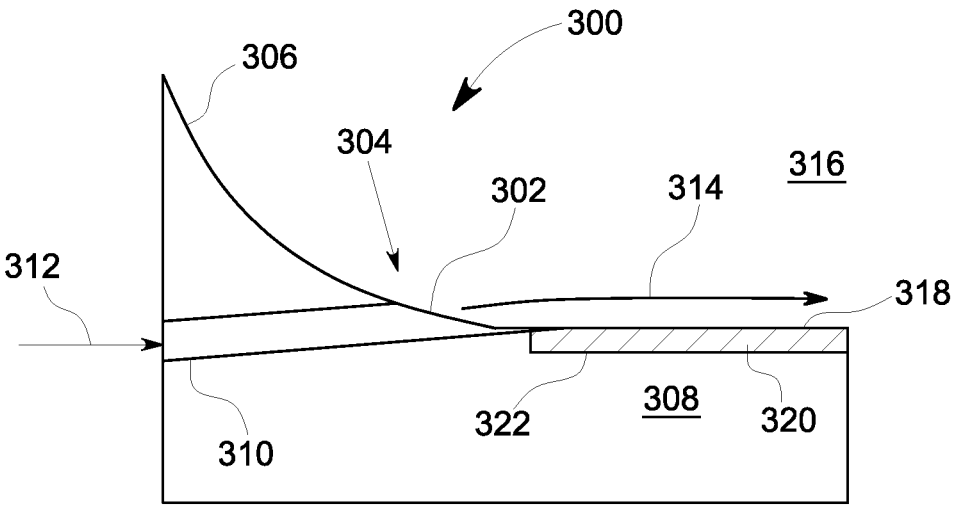
FIG. 3 is a detailed schematic drawing of an embodiment of a portion of a turbine airfoil.

FIG. 3 is a detailed schematic drawing of an embodiment of a portion of a turbine nozzle 300. The turbine nozzle 300 includes a diffuser 302 proximate an interface 304 of an airfoil trailing edge 306 and sidewall 308. A cooling fluid 312 is directed from a passage 310 through the diffuser 302, as shown by flow 314, toward a high temperature region 316. In an embodiment, the high temperature region 316 refers to the turbine components, such as portions of sidewall 308, as well as an area near the components that experience increased temperature and pressure relative to other components in the same area of the turbine. The cooling fluid cools the high temperature region 316 and interface 304 as well as the trailing edge 306 and sidewall 308. In an embodiment, hot gas flow from the combustor causes formation of high temperature and high pressure regions in the nozzle 300 such as near the trailing edge 306 and sidewall 308. The arrangement of diffuser 302 and passage 310 proximate interface 304 improves the cooling of one high temperature region in the nozzle 300. The cooling fluid flows through diffuser 302, as shown by arrow 314, wherein the flow forms a film of cooling fluid on a surface 318 of the sidewall 308. In one embodiment, the surface 318 may comprise a thermal barrier coating 320. The thermal barrier coating 320 comprises any suitable thermal protective materials. In one non-limiting example, the thermal barrier coating 320 comprises a metal substrate, metallic bond coat, and ceramic topcoat. The thermal barrier coating 320 insulates turbine components, such as the sidewall 308, from prolonged heat loads by utilizing thermally insulating materials, which enable a significant temperature difference between the metallic alloys of the components and the coating surface. Accordingly, the thermal barrier coating 320 allows for higher operating temperatures while limiting the thermal exposure of turbine components, such as sidewall 308. In the depicted embodiment, the diffuser 302 and passage 310 are arranged in a position that creates a ledge 322 similar in dimension to the thickness of the thermal barrier coating 320. As the thermal barrier coating 320 is applied to the sidewall 308, the ledge 322 is filled providing a smooth transition for cooling flow 314 as it exits the diffuser 302. This arrangement eliminates additional manufacturing steps to provide the improved interface 304 while allowing cooling flow 314 to form a film of cooling fluid on a surface 318 of the sidewall 308.

Figure 4:
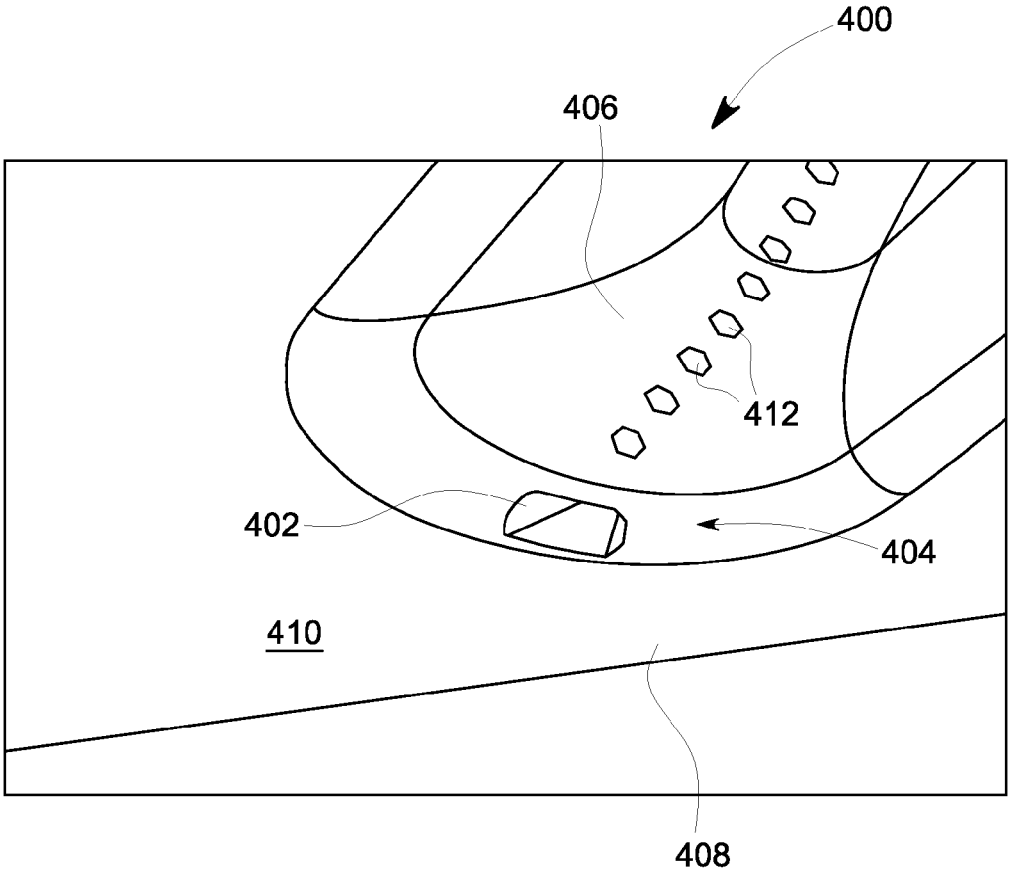
FIG. 4 is a detailed perspective view of an embodiment of a portion of a turbine airfoil.

FIG. 4 is a detailed perspective view of an embodiment of a portion of a turbine nozzle 400. The nozzle 400 includes an elliptical diffuser 402 positioned at or proximate an interface 404 of the trailing edge 406 and sidewall 408. The elliptical diffuser 402 is coupled to a cooling fluid passage, wherein the cooling fluid flows from the elliptical diffuser 402 to control a temperature of nozzle parts near the interface 404 and the nearby high temperature region. The elliptical diffuser 402 may be configured to form a film on a surface 410 of the sidewall 408, where the formation of the film cools the surface 410. The cooling fluid passage of elliptical diffuser 402 also cools trailing edge 406 by convection and conduction. As depicted, the airfoil trailing edge 406 includes a plurality of passages 412 to cool the airfoil. In an embodiment, a cooling fluid supply routes compressed air, or any other suitable cooling fluid, to a plurality of passages or channels on the airfoil and the backside of sidewall 408, wherein the elliptical diffuser 402 improves a cooling of the sidewall 408, trailing edge 406 and interface 404, thereby extending the life of nozzle components, such as the airfoil and sidewall 408.

Figure 5:
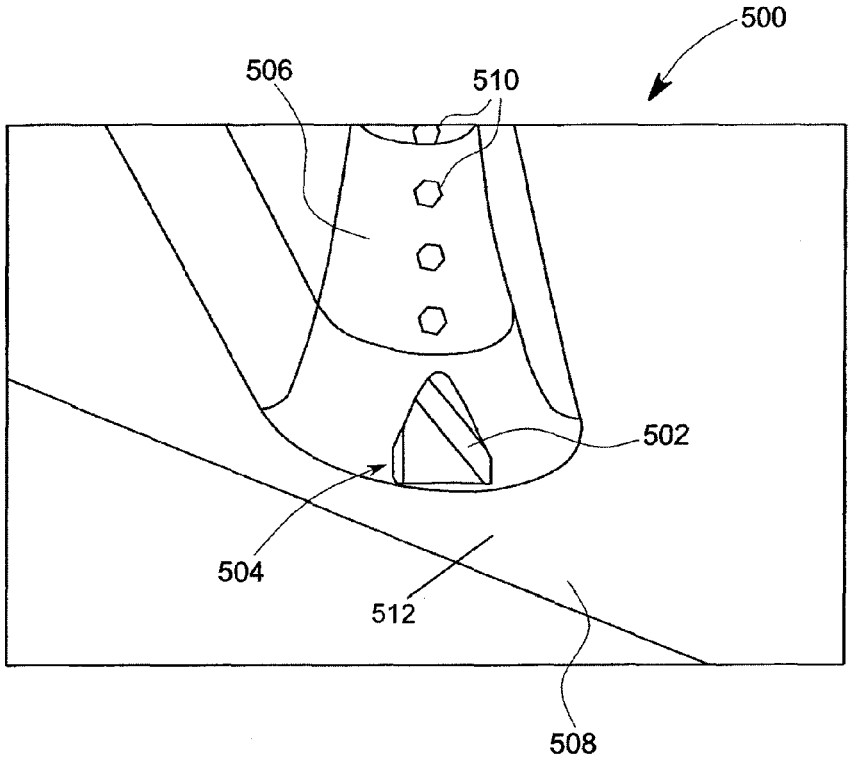
FIG. 5 is a detailed perspective view of another embodiment of a portion of a turbine airfoil.

FIG. 5 is a detailed perspective view of another embodiment of a portion of a turbine nozzle 500. The nozzle 500 includes a triangular diffuser 502 positioned at an interface 504 of the trailing edge 506 and sidewall 508. The triangular diffuser 502 is coupled to at least one cooling fluid passage, wherein the cooling fluid flow from diffuser 502 controls a temperature of nozzle parts near the interface 504 and the nearby high temperature region 512. The airfoil trailing edge 506 includes a plurality of passages 510 to cool the airfoil. It should be noted that the shape of the opening of the diffuser 502 may be any suitable shape for cooling selected parts of the turbine. The shape of the diffuser 502 may be selected based on application specific parameters, manufacturing constraints and/or costs. In one embodiment, passages 510 are drilled in the airfoil and the diffuser 502 is formed by electrochemical-mechanical milling or grinding the opening to the selected shape. In another embodiment, the passages 510 and diffuser 502 are cast in the selected shapes.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An airfoil to be placed between a first and second sidewall of a gas turbine, the airfoil comprising:

a leading edge of the airfoil;

a trailing edge of the airfoil, wherein the trailing edge comprises a first interface where the trailing edge is coupled to the first sidewall;

a first passage proximate the first interface, the first passage configured to receive a cooling fluid; and a first diffuser in fluid communication with the first passage, the first diffuser configured as a contoured opening that directs the cooling fluid to cool the first interface and to cool a surface of the first sidewall by promoting formation of a film of cooling fluid on the surface of the first sidewall.

2. The airfoil of claim 1, comprising a plurality of passages, including the first passage, the plurality of passages being proximate the trailing edge, wherein the cooling fluid flows through the plurality of passages to cool the trailing edge.

3. The airfoil of claim 1, wherein the first diffuser is configured to cool the surface of the first sidewall and the airfoil trailing edge to reduce wear of the first sidewall and airfoil.

4. The airfoil of claim 1, wherein the trailing edge comprises a second interface where the trailing edge is coupled to the second sidewall and wherein the airfoil comprises a second passage proximate the second interface configured to receive the cooling fluid.

5. The airfoil of claim 4, comprising a second diffuser in fluid communication with the second passage, wherein the second diffuser is configured to direct the cooling fluid to cool a surface of the second sidewall.

6. The airfoil of claim 1, wherein the cooling fluid comprises compressed gas that forms the film on the surface of the first sidewall to cool the surface.

7. The airfoil of claim 1, wherein a flow of gas within the gas turbine causes a high temperature region near the first interface.

8. The airfoil of claim 1, wherein cooling fluid is directed to a first channel on a backside of the airfoil to cool the airfoil and a second channel on a backside of the first sidewall to cool the first sidewall.

9. The airfoil of claim 1, wherein the first diffuser comprises one selected from the group consisting of a triangular diffuser or an elliptical diffuser.

10. A method for cooling an interface of a trailing edge of an airfoil and a sidewall of a gas turbine, the method comprising:

directing a cooling fluid to at least one passage in the trailing edge;

directing the cooling fluid from the at least one passage to a diffuser configured as a contoured opening proximate the interface of the trailing edge and the sidewall; and flowing the cooling fluid from the diffuser to promote formation a film of the cooling fluid on a surface of the sidewall and the interface, thereby cooling the sidewall.

11. The method of claim 10, wherein directing the cooling fluid comprises directing the cooling fluid to a plurality of passages proximate the trailing edge, wherein the plurality of passages include the at least one passage, wherein the cooling fluid flows through the plurality of passages to cool the trailing edge.

12. The method of claim 10, wherein flowing the cooling fluid from the diffuser comprises flowing the cooling fluid to a high temperature region of the sidewall, the high temperature region being proximate the interface.

13. The method of claim 10, wherein directing the cooling fluid comprises directing a compressed gas from a compressor.

14. The method of claim 10, wherein directing the cooling fluid from the at least one passage to the diffuser comprises directing the cooling fluid to one selected from the group of: a triangular diffuser or an elliptical diffuser.

15. A turbine, comprising:

a first sidewall;

an airfoil positioned between the first sidewall and a second sidewall;

a first passage in the airfoil proximate a high temperature region, the first passage configured to receive a cooling fluid, wherein the high temperature region is near a first interface of the first sidewall and a trailing edge of the airfoil; and a first diffuser in fluid communication with the first passage, the first diffuser configured as a contoured opening that directs the cooling fluid to cool the first interface and to cool a surface of the first sidewall by promoting formation of a film of cooling fluid on the surface of the first sidewall.

16. The turbine of claim 15, wherein the airfoil comprises a second passage proximate a second high temperature region near a second interface of the trailing edge of the airfoil and the second sidewall.

17. The turbine of claim 16, comprising a second diffuser in fluid communication with the second passage configured to receive the cooling fluid, wherein the second diffuser is configured to form a film on a surface of the second sidewall.

18. The turbine of claim 15, wherein the first diffuser comprises one of a triangular diffuser or an elliptical diffuser.

19. The turbine of claim 15, wherein the first sidewall comprises a thermal barrier coating.

20. The turbine of claim 19, wherein the thermal barrier coating is a filling formed in a step of the sidewall to provide a smooth transition for cooling fluid from the first diffuser.

* * * * *